United States Patent [19]

Billberg

[11] Patent Number: 4,625,902

[45] Date of Patent: Dec. 2, 1986

[54] METHOD AND ARRANGEMENT FOR THE FEEDING OF A MATERIAL WEB

[75] Inventor: Alf Billberg, Oxie, Sweden

[73] Assignee: Tetra Pak International AB, Lund, Sweden

[21] Appl. No.: 821,510

[22] Filed: Jan. 22, 1986

Related U.S. Application Data

[63] Continuation of Ser. No. 575,765, Feb. 1, 1984, abandoned.

[30] Foreign Application Priority Data

Feb. 10, 1983 [SE] Sweden ..... 8300706

[51] Int. Cl.[4] ..... B65H 20/04; B65H 20/22; B65H 23/16

[52] U.S. Cl. ..... 226/2; 226/6; 226/76; 226/87; 226/143; 226/153; 226/155; 226/187; 226/190

[58] Field of Search ..... 226/2, 6, 143, 190

[56] References Cited

U.S. PATENT DOCUMENTS

| | | | |
|---|---|---|---|
| 2,358,411 | 9/1944 | May | 226/169 |
| 2,946,281 | 7/1960 | Sohn | 226/153 X |
| 3,058,641 | 10/1962 | Peterson | 226/153 X |
| 3,531,591 | 9/1970 | Jarmy | 226/76 X |
| 3,724,734 | 4/1973 | Sachtleben et al. | 226/154 X |
| 3,726,455 | 4/1973 | Sandbach | 226/87 X |
| 3,767,098 | 10/1973 | Pabodie | 226/168 X |
| 3,972,460 | 8/1976 | Kesinger et al. | 226/85 X |
| 3,977,586 | 8/1976 | Hertrich | 226/143 X |
| 4,364,504 | 12/1982 | Meyers | 226/76 |

FOREIGN PATENT DOCUMENTS

| | | | |
|---|---|---|---|
| 520207 | 6/1955 | Belgium | 226/116 |
| 300011 | 5/1971 | U.S.S.R. . | |

*Primary Examiner*—Harvey C. Hornsby
*Assistant Examiner*—Scott J. Haugland
*Attorney, Agent, or Firm*—Burns, Doane, Swecker & Mathis

[57] ABSTRACT

A more space-effective method and device for the feeding of a material web (1) is obtained by making use of a web feeding unit (2) for feeding as well as correction of register. The web feeding unit (2) is provided for this purpose with two driving devices (14,15) which during operation are used alternately for feeding and register correction respectively of the material web.

3 Claims, 5 Drawing Figures

METHOD AND ARRANGEMENT FOR THE FEEDING OF A MATERIAL WEB

This application is a continuation of Ser. No. 575,765, filed Feb. 1, 1984, now abandoned.

FIELD OF THE INVENTION

The present invention relates to a method for the feeding of a patterned material web for processing in register with the pattern of the material web, this method comprising a stepwise feeding of the material web and a register correction performed prior to each processing operation.

The invention also relates to an arrangement for the realization of the method, this arrangement comprising a feeding unit for the material web.

DISCUSSION OF THE PRIOR ART

The processing of moving material webs occurs frequently in different sections of industry and comprises varying types of processing, e.g. printing, punching or cutting of a multitude of different materials such as metal, plastics, paper or combinations thereof. In the packaging industry, weblike laminated material is often used which comprises different layers of e.g. plastics and paper for the manufacture of individual packing containers for various types of contents such as milk, juice or the like. Prior to conversion to individual packing containers, the laminated material is processed whilst it is still in the form of a web and is provided with such features as empyting openings, cover strips, crease lines or printed marks. Moreover the moving material web is often divided into individual packing container blanks, these blanks being fed subsequently into the packaging machine proper to be converted to packing containers and filled with contents. The different processing operations usually have to be done in register with earlier processing stages, and it is also customary for the web to have been provided with a geometrical pattern of e.g. crease lines or a printed decorative pattern before the processing operations. In this context it is of course of the greatest importance that the processing operations are carried out in register and with the said pattern so that the pattern will be in correct position on the finished packing container.

The abovementioned requirement of keeping a moving packing material web in register during processing can be met by a multitude of different methods. According to a frequently used method the feed is carried out in steps in rhythm with the processing units in that each step is introduced by a first feeding in which the material web is advanced over a distance which substantially corresponds to the pattern division of the material web. Then a correction of the position of the material web takes place before the processing operation. During the correction the web is displaced over a comparatively short distance until the detector devices, e.g. photocells, crease line finders or the like, transmit signals to a feeding device that the web is in correct position for the processing operation. Thereupon, the processing is carried out and the first feeding is resumed so that the material web is advanced a step further for the next processing operation. The feeding of the material web takes place in this known method with the help of cooperating cylinders and for the correction movement separate detector and position adjustment devices are used. The method operates satisfactorily but is fairly slow, since the first feed has to be stopped completely before the position correction can be made. The distance between the different devices which advance the material web and detect and control its position moreover has the effect that elongation and stretching of the material web occur which have a negative effect on accuracy. Finally, the relatively greater number of cooperating units makes the design complicated and increases the risk of operational failures.

The difficulties in the feeding of a material web in register with the pattern of the web is particularly great in those cases where the subsequent processing involves the dividing up of the material web into individual packing material blanks by cutting, since the cutting off process means that the web can no longer be pulled forward through the register-keeping unit with the help of a driving element arranged after the same. Instead the web has to be fed to the processing unit with the help of a feeding unit which precedes the processing unit. In a rational manufacturing process, the feeding has to take place at great speed and with high demands of accuracy insofar as the keeping in register is concerned and no method or arrangement has been put forward up to now which would allow the feeding of a material web to a cutting unit which is both fast and accurate.

OBJECTS OF THE PRESENT INVENTION

It is an object of the present invention to provide a method which would make it possible to feed a sheet to a subsequent processing tool with accurate keeping in register without any part of either the feeding or the keeping in register having to be carried out after the processing tool as seen in the direction of movement of the material web.

It is a further object of the present invention to provide a method of feed which is quick, simple and exact and which is not subject to the disadvantages of known, similar feeding methods, e.g. sensitivity to changes in length of the material web.

SUMMARY OF THE INVENTION

These and other objects have been achieved in accordance with the invention in that the method of the type described in the introduction has been given the characteristic that the material web at each feeding step is advanced by means of friction engagement with a web feeding unit over a distance which substantially agrees with the desired feeding distance, whereupon the web feeding is interrupted and the correct register position for the following processing operation is imparted to the material web by means of a form-fitting engagement between the material web and the web feeding unit.

It is a further object of the present invention to provide an arrangement for the realization of the method, this arrangement not being subject to the disadvantages of earlier arrangements.

It is a further object of the present invention to provide an arrangement which operates in accordance with a simple principle and uses simple mechanical components which, therefore, has high accuracy and operational safety.

It is a further object of the present invention to provide an arrangement wherein devices for first as well as for fine feeding are arranged as one unit.

These and other objects have been achieved in accordance with the invention in that an arrangement of the type mentioned in the introduction has been given the characteristic that the feeding unit comprises two driving devices, namely on the one hand a driving surface for friction engagement with the material web, on the other hand two projections for form-fitting engagement with the material web, the two driving devices being adapted so as to be brought alternately into engagement with the material web for the periodical adjustment of the driving position of the material web in relation to a processing unit.

The method and the arrangement in accordance with the invention make possible an exact and rapid feeding of a material web to a subsequent processing device which e.g. may be a cutting device which divides the material web into individual sheets, since no part of either the feeding unit or the remaining devices which are required for keeping in register are situated after the processing unit. Owing to both driving devices, that is to say the driving device for the first feeding as well as for the register correction being designed as one unit, no extensions caused by external forces will affect the accuracy, so that the arrangement has great potentialities for making it operate quickly and with high accuracy.

A preferred embodiment of the method as well as of the arrangement in accordance with the invention will now be described in more detail with special reference to the attached schematic drawing which only shows the components necessary for an understanding of the invention.

DETAILED DESCRIPTION OF THE PREFERRED EMBODIMENTS

Figure 1:
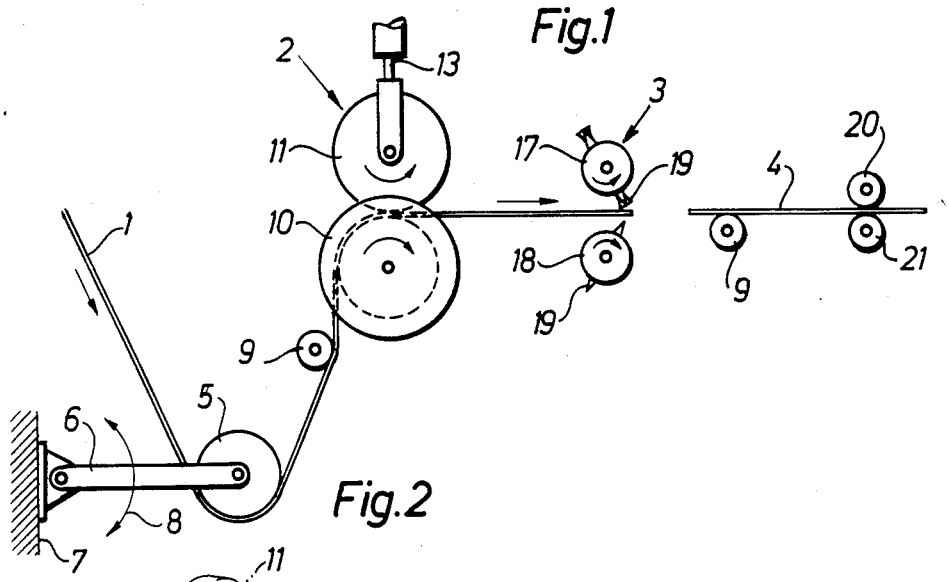
FIG. 1 is a lateral view which illustrates the principle of operation as well as the build-up of the arrangement in accordance with the invention.

Referring to FIG. 1, a material web, 1 which runs from left to right in the figure, is guided through a feeding unit 2 in accordance with the invention to a processing unit 3 to be divided into individual sheets or blanks 4. The material web 1 for example may be a web of packing laminate which comprises a central carrier layer of paper which is coated on either side with liquid-tight layers of thermoplastic material, for example polyethylene. Such a packing laminate is used, for example, for the manufacture of non-returnable packages for milk, cream or juice. The laminate web is first divided in into individual sheets or packing container blanks, and then converted successively to individual packing containers which are filled with the desired contents and sealed. The conversion of the packing container blanks or sheets 4 to individual filled and sealed packing containers may be done according to known methods in packaging machines of known type and is not described, therefore, in any detail in the present context.

The material web 1 runs from a magazine roll (not shown) and a pair of driving rollers (also not shown), which feed the web from the magazine roll and forward to the arrangement in accordance with the invention. The web is conducted at this from the driving rollers and possibly via further elements, not shown, to a pendulum roller 5 which by lever arms 6 is supported pivotably in the machine frame 7. The pendulum roller 5 can swivel substantially upwards and downwards around the support of the lever arms 6 in the frame 7, which motion is indicated by means of the arrow 8. The swivelling movements of the pendulum roller 5 are made use of for the control of the rotation of the driving rollers (not shown) and hence the feeding of the web to the processing unit 3 in the rhythm as required. With the help of electric position detectors or the like, the driving rollers are controlled so that the pendulum roller always moves between two defined limit positions. The momentary position of the pendulum roller thus varies continuously during operation of the arrangement and is connected not only with the web feeding induced by the driving rollers but also with the operation of the feeding unit 2 which will be explained in more detail in the following discussion. The load on the material web exercised by the pendulum roller may be regulated to a value appropriate for the purpose through adjustment of the weight of the pendulum roller or through e.g. spring loading of the pendulum roller.

After the material web 1 has passed the pendulum roller 5 it is guided via a freely rotatable guide roller 9 supported in the frame 7 to the feeding unit 2 constructed in accordance with the invention. The feeding unit 2 comprises a feeding cylinder 10 and one or more compression rollers 11 co-operating with the peripheral surface of the same. The feeding cylinder 10 is supported so that it can rotate in the frame 7 of the machine whilst the compression rollers 11 are supported on an axle 12 (FIG. 2, FIG. 5) which in turn is supported so that it can move vertically in the frame 7 of the arrangement at some distance above the axis of rotation of the cylinder 10. The compression rollers 11 are acted upon by means of a spring device 13 which may be a mechanically operating spring or some pneumatic or hydraulic piston and cylinder unit so as to lie against the peripheral surface of the cylinder 10.

Figure 2:
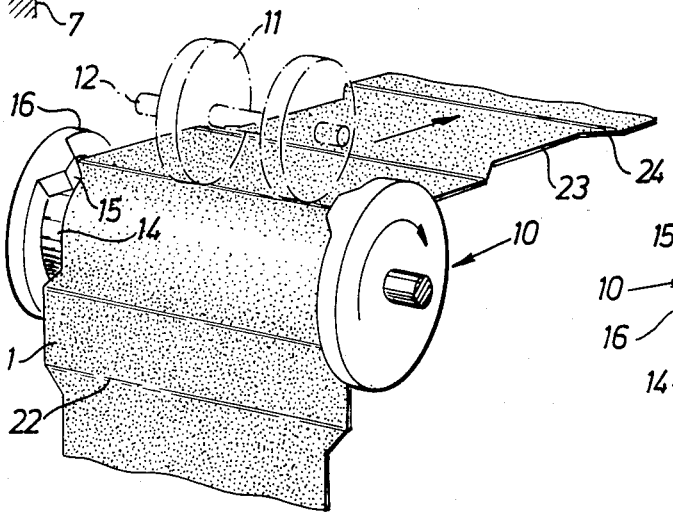
FIG. 2 shows in perspective a feeding unit with a material web passing through it in accordance with the invention.
Figure 3:
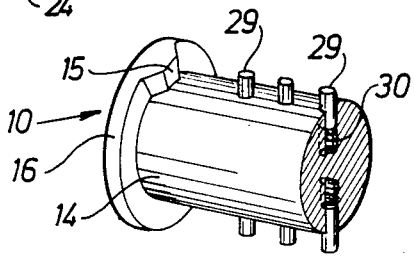
FIG. 3 shows in perspective a part of a second embodiment of the feeding unit in accordance with the invention.

As is evident more clearly from FIG. 2 the cylinder 10 comprises two driving devices, namely on the one hand a driving surface 14 for friction engagement with the material web 1, on the other hand projections 15 for form-fitting engagement with the peripheral edges of the material web. The projections 15 are located opposite one another on flanges 16 which are situated on both sides of the driving surface 14 and delimit the same in lateral direction. Each flange 16 has two projections 15 situated diametrically opposite each other. Above the cylinder 10 the driving unit, as mentioned earlier, has two compression rollers 11 indicated by dash-dotted lines and the freely rotatable axle 12 of the same which is supported so that it is vertically movable.

After the material web 1 has passed the driving unit 2 in accordance with the invention it approaches the processing unit 3 (FIG. 1) which comprises two cutting rollers 17,18 which are rotatable in opposite directions. One of the cutting rollers 17,18 is provided with cutting elements 19 in the form of knives situated diametrically opposite each other and extending parallel with the centre axes of the cutting rollers. The other cutting roller also has diametrically oppositely situated cutting elements 19 in the form of hold-up tools which have a plane working surface with a wearing coat of e.g. plastics. The cutting elements 19 of the two cutting rollers 17,18 co-operate with each other so that on synchronous rotation of the cutting rollers they cut off the material web 1 in transverse cuts and divide the same into individual sheets. The two cutting rollers 17,18 are driven synchronously with one another and with the cylinder 10 by means of the driving motor mentioned earlier.

The material divided up into individual sheets or packing container blanks 4 is then conducted via one or more guide rollers 9 situated after the processing unit 3 into the gap between two driving rollers 20,21 which during operation of the arrangement rotate at a higher speed than the cutting rollers 18. The sheet 4 will thus be removed from the processing unit 3 at an accelerated rate thus preventing the separated sheet 4 from making contact with the front edge of the subsequent material web 1 and disturbing or hindering the course of cutting in the processing unit 3. The driving rollers 20,21 feed the individual sheets to a collecting hopper or conveyor (not shown), whereafter the sheets are conveyed further manually or automatically to the packaging machine for the conversion to individual packing containers.

During the feeding of the material web 1 through the arrangement in accordance with the invention it is ensured that the material web is divided into individual sheets or blanks 4 in register with the pattern of the material web. As is evident from FIG. 2, the material web 1 which is to be processed is provided with transverse crease lines 22 and with recesses 23 situated at the two longitudinal edges of the material web 1. The recesses 23 impart irregular edges to the material web which are used in accordance with the invention for keeping the material web in register during the feeding and processing in the processing unit 3. Naturally it is possible in other types of material webs to make use of different irregularities, e.g. cuts or emptying openings for the keeping in register. To this end an adaptation of the elements 15 of the driving cylinder 10 engaging with the material web is required.

When the arrangement is in operation the material web 1 is fed with the help of friction engagement between the material web and the driving surface 14 of the cylinder 10. The engagement is ensured by means of the compression rollers 11 which by means of the spring element 13 are urged to lie against the material web 1 and press the same against the driving surface 14 so that the advance can take place without any slipping between the web and the driving surface 14, that is to say the web will be advanced at a speed which fully corresponds to the peripheral speed of the driving surface 14. The circumference of the driving surface 14 is approx. 1% greater than the desired length of one or more material sheets 4 and in the embodiment shown the circumferential length of the driving surface corresponds to the length of two material sheets plus a further 1% to cover any deviations from the correct distance which may exist between the recesses 23 in the material web used for the keeping in register. The driving cylinder 10 rotates at a constant peripheral speed which corresponds to the speed of the cutting rollers 17,18. Owing to the one-percent overdimension of the cylinder circumference this means that the material web is normally advanced a little too far at each feed. This overfeeding is intended to be slightly greater than the maximum deviation in the distance between successive recesses 23 permissible according to the tolerance requirements on the material web. These deviations have to be corrected continuously so that they do not mount up to an accumulated effect which would seriously upset the accuracy of the processing unit. This is ensured in accordance with the invention in that at each feeding step the material web 1 is advanced first, as mentioned earlier, by means of friction engagement with the driving surface 14, over a distance which by and large corresponds to (and according to the preferred embodiment slightly exceeds) the desired feeding distance, whereupon the web feed is interrupted and the material web 1 is brought into the correct register position for the subsequent processing operation by means of form-fitting engagement between the material web 1 and the web feeding unit. More particularly, the web feeding is interrupted after each drive by means of the driving surface 14 in that the contact pressure of the web against the driving surface 14 is reduced, which means that the material web 1 can slip in relation to the driving surface 14. The slipping is induced by the pendulum roller 5 which drops and thereby lengthens the distance which the material web 1 must move from the feed cylinders (not shown), driving at continuous speed to the feeding unit 2. Upon this event, the portion of the web which passes the feeding unit 2 is retarded until the projections 15 have effected contact with the front edge 24 of the co-operating recesses 23. When this has occurred and the material web 1 is thus in a fixed, form-fitting engagement with the cylinder 10 the friction engagement between the web and the driving surface 14 is re-established with the help of the compression rollers 11, whereupon the cutting off of the material web can take place in the correct register position in relation to the recesses 23, since the cutting rollers 17,18 rotate synchronously with the cylinder 10. To make possible the slipping between the material web and the cylinder until the projections 15 have effected contact with the front edge 24 of the recesses 23 it is essential that the projections 15 should be narrower than the recesses, that is to say the extension of the projections 15 in longitudinal direction of the driving surface 14 in general should be less than the length of the geometrical irregularities 23 in the material web with which the projections are adapted to engage.

In continuous operation of the feed unit in accordance with the invention the procedure described is repeated for each processing, that is to say before each cutting off of a sheet or packing container blank 4 from the web. In the preferred embodiment the cylinder 10 is provided with two projections 15 located diametrically opposite each other and the driving surface 14 should thus have a total circumference which exceeds the length of two blanks 4 by a dimension which is equal to or slightly greater (approx. 1%) than the maximum plus tolerance which is permitted in the repeat or register length, that is to say the distance between two successive recesses 23 on the material web. In the case of a sheet length of approx. 300 mm a typical over-dimension of 3 mm is chosen which means that after the feeding of a sheet (rotation of half a turn) the cylinder 10 has advanced the material web 2–3 mm too much. The front edge 24 of the recesses 23 is thus slightly in front of the corresponding front surface of the projections 15 which, as mentioned earlier, is corrected prior to the cutting off in that the friction engagement between the web and the cylinder is lifted and the web is retarded with the help of the pendulum roller until the form-fitting engagement between the projections and the recesses has been established again. Owing to the alternate activation of the two driving devices 14,15 a periodical adjustment of the driving position of the material web in relation to the processing unit is ensured, as a result of which any accumulation of length errors is fully prevented and the keeping in register is assured during continuous operation of an indefinite time.

The first feeding of the web which takes place during the time the web is in friction engagement with the driving surface 14 on the cylinder 10 was an overfeeding in the embodiment described, that is to say the feeding distance was greater than the correct repeat length for the material and the correction feeding retarded or drew back the web until the form-fitting engagement with the projection 15 was obtained and the web was thus in the correct position. Naturally the opposite is also conceivable, that is to say the web can be advanced in the first instance over slightly too short a distance, whereafter correction is made by momentarily increasing the speed of the web, so that the form-fitting engagement and consequently the correct register position is obtained. However, this solution seems to be more complicated and space demanding, since it would require a further pair of feed rollers between the feeding unit 2 and the processing unit 3. The method of operation, though, on principle will be similar.

Figure 4:
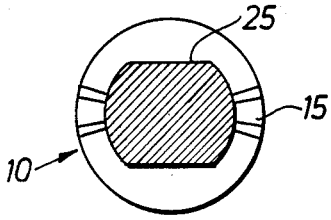
FIG. 4 is a section through the feeding unit in accordance with FIG. 2.

The release of the friction engagement between the continuously rotating cylinder 10 and the material web is brought about in accordance with a preferred embodiment of the invention shown in FIG. 4 in that the substantially cylindrical driving surface 14 of the cylinder 10 is provided with two bevelled substantially plane areas 25. By limiting the path of movement of the compression rollers 11 with the help of the spring element 13 or in some other manner, contact between the cylinder 10 and the compression rollers is prevented when the cylinder assumes a position where anyone of these bevelled surfaces 25 faces towards the compression rollers. At this the material web can slip in relation to the cylinder so that the form-fitting engagement between the projections and the material web is achieved. When this has taken place the cylinder 10 has rotated further through such an angle that the cylindrical portion of the driving surface 14 once again is situated straight under the compression rollers 11, as a result of which they will once more clamp the web against the driving surface 14 so that the friction engagement can take over the web feed and the edges 24 are disengaged. The contact between the edges 24 and the lips 15 thus exists only for a short while and this helps to prevent any deformation of the material web at the recesses 23.

Figure 5:
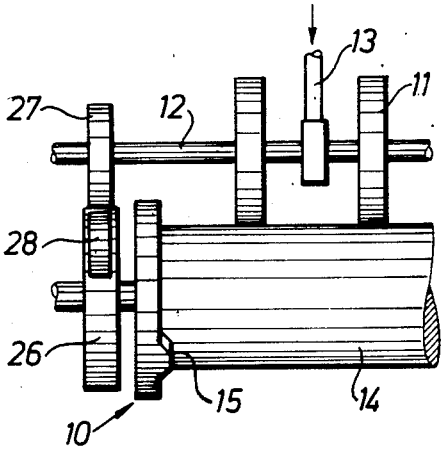
FIG. 5 shows from the side a part of a driving unit in accordance with a third embodiment of the invention.

The friction engagement between the material web 1 and the driving surface 14 of the cylinder 10 can also be interrupted in a different manner, e.g. as shown in FIG. 5, in that the compression rollers 11 are periodically lifted from their position against the cylinder 10. To this end the embodiment shown in FIG. 5 comprises a cam 26 fixed to the cylinder 10 which cooperates with and acts upon a cam follower pulley 27 arranged on the axle 12 of the compression rollers 11. Owing to this arrangement, which can be doubled and be present on both ends of the driving cylinder 10, the axle 12 of the compression rollers 11 will be lifted periodically from its position against the compression roller 10 so that the pressure against the material web is eased and the latter can slip in relation to the driving surface 14 which in this embodiment may be wholly cylindrical and thus lack the plane, bevelled areas 25. The cam 26 may be designed as a simple cylindrical roll whose periphery is provided with lips 28 at the points where lifting of the compression rollers 11 is desirable, that is to say essentially 90° before the projection 15 of the cylinder 10. This placing, which also corresponds to the placing of the bevelled surfaces 25 in the embodiment according to FIG. 4, means that the compression rollers 11, on rotation of the cylinder 10 will disengage the material web 1 directly after the projections 15 have entered into the corresponding recesses 23 in the material web, which provides maximum time for register correction before, owing to the rotation of the cylinder 10 and the advance of the web, the projections 15 again leave the recesses 23.

When the feed unit in accordance with the invention is to be used for material webs of different width, the cylinder 10 has to be substituted or adapted in some other manner to a different web width, e.g. by adapting the flanges 16 so that they can be shifted and fixed at various distances from one another on the cylinder 10. As is evident from the figure this embodiment of the cylinder, like the embodiment described earlier, requires a driving surface 14 and flanges 16 only one of which, however, is visible. This flange 16, however, lacks projections 15 and the cylinder is provided inserted with a number of pegs 29 which are placed in radial holes in the driving surface 14. The pegs 29 are spring-loaded in a direction outwards from the centre axis of the cylinder by means of compression springs 30 of such a strength that a material web 1 lying against the pegs 29 would be able to press the pegs fully down into the surface 14 of the cylinder. On the periphery of the material web 1, however, the pegs 29 are able to remain in projecting position so that they can engage in recesses in the longitudinal edges of the material web and thus fulfil the same function as the projections 15. This design makes possible a wholly automatic adaptation of the cylinder 10 to material webs 1 of different width and can be combined with the different realizations of the driving surface 14 of the cylinder and the manoeuvering of the compression rollers 11 as described earlier. The peglike projections can also be used advantageously when a material web is to be processed in register with holes (e.g. emptying openings) provided in the material web, in which case of course the projections must present a smaller extension seen in the direction of the web than the extension of the corresponding holes.

Variations and changes to the present invention will become readily apparent to one skilled in the art upon reading the present specification. Thus, it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

I claim:

1. A system for severing packaging blanks of a predetermined length from a continuous web having longitudinal borders, a maximum width and recesses at uniform intervals along each longitudinal border, said uniform intervals corresponding with said predetermined length, said system comprising:

means for cyclically cutting the continuous web to separate packaging blanks from said continuous web;

tension roller means for applying tension in said continuous web;

a rotatable drive cylinder between said cutting means and said tension roller means, said drive cylinder being spaced from said cutting means and having a driving surface of a circumferential length greater than said predetermined length, a pair of radial flanges at opposite ends of said driving surface and longitudinally spaced apart according to said maximum width and a pair of longitudinally spaced lugs projecting radially outwardly from said driving surface at circumferentially fixed locations adjacent each flange, said lugs being shaped so as to be initially received with circumferential clearance by said recesses of continuous web guided onto said driving surface, said pair of lugs being positioned relative to said driving surface to define at a rotational position of said drive cylinder a feed length corresponding with said predetermined length;

means for rotating said drive cylinder continuously at a substantially constant speed;

means for guiding the continuous web onto said drive cylinder;

compression roller means for pressing the continuous web into engagement with said driving surface at said drive cylinder rotates so that said drive cylinder feeds to said cyclical cutting means an initial length of the continuous web greater than said predetermined length; and means for cyclically disengaging said compression roller means as said drive cylinder rotates, said cyclically disengaging means including bevelled areas on said drive cylinder, said bevelled areas being adapted to periodically relieve the engagement of the continuous web with the driving surface so that said lugs are moved by the drive cylinder relative to the continuous web into registration with edges of a pair of said recesses as said drive cylinder moves into said rotational position, whereby the position at which the web is cut is accurately controlled relative to the web recess.

2. A method for severing packaging blanks of a predetermined length from a continuous web having longitudinal borders, a maximum width and recesses at uniform intervals along each longitudinal border, said uniform intervals corresponding with said predetermined length, said method comprising the step of:

continuously rotating at a constant speed a drive cylinder having a driving surface of a circumferential length greater than said predetermined length, a pair of radial flanges at opposite ends of said driving surface and longitudinally spaced apart according to said maximum width and a pair of longitudinally spaced lugs projecting radially outwardly from said driving surface at locations adjacent each flange, said lugs being shaped so as to be initially received with circumferential clearance by said recesses of said continuous web;

feeding said continuous web onto the driving surface of said rotating drive cylinder with said pair of lugs protruding into a pair of said recesses of said continuous web with circumferential clearance as said drive cylinder rotates;

pressing the continous web against said drive surface with a compression roller so as to feed the continuous web from the rotating drive cylinder according to an initial length greater than said predetermined length;

applying tension to said continuous web in a direction opposite to the direction of rotation of said driving surface;

adjusting said initial length to said predetermined length by cyclically interrupting said pressing step to allow the tension in the continuous web to retract the continuous web while moving said pair of lugs into registration with edges of said pair recesses; and cutting a predetermined length of the continuous web while said lugs are registered with said edges.

3. The system in accordance with claim 1, wherein the circumferential length of the driving surface is approximately 1% greater than said predetermined length of the web.

* * * * *